US012007159B2

(12) United States Patent
Zha

(10) Patent No.: US 12,007,159 B2
(45) Date of Patent: Jun. 11, 2024

(54) HOT GAS DEFROST USING LOW TEMPERATURE COMPRESSOR DISCHARGE GAS AND AUXILIARY FLASH TANK

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 47 days.

(21) Appl. No.: 17/844,659

(22) Filed: Jun. 20, 2022

(65) Prior Publication Data

US 2023/0408167 A1 Dec. 21, 2023

(51) Int. Cl.
*F25D 21/12* (2006.01)
*F25D 21/00* (2006.01)

(52) U.S. Cl.
CPC ..... *F25D 21/125* (2013.01); *F25D 21/006* (2013.01)

(58) Field of Classification Search
CPC ..... F25D 21/06; F25D 21/02; F25D 21/022; F25D 2317/04111; F25B 2400/23; F25B 2400/16; F25B 2600/2501; F25B 5/04; F25B 47/025; F25B 2347/021
See application file for complete search history.

(56) References Cited

U.S. PATENT DOCUMENTS 4,012,921 A 3/1977 Willitts et al.
4,589,263 A * 5/1986 DiCarlo ..... F25B 41/20 62/193
9,377,236 B2 6/2016 Hinde et al.
2014/0326018 A1* 11/2014 Ignatiev ..... F25B 49/02 62/527
2014/0352343 A1* 12/2014 Hinde ..... F25B 7/00 62/277
2015/0285539 A1* 10/2015 Kopko ..... F25B 41/39 62/324.1

FOREIGN PATENT DOCUMENTS

DE 10233411 A1 2/2004
EP 1498673 B1 8/2013
FR 2933482 A3 1/2010
WO 2011054397 A1 5/2011

* cited by examiner

*Primary Examiner* — Nelson J Nieves
*Assistant Examiner* — Meraj A Shaikh
(74) *Attorney, Agent, or Firm* — Baker Botts L.L.P.

(57) ABSTRACT

A refrigeration system includes a controllable valve positioned downstream from one or more low-temperature compressors. The controllable valve receives compressed refrigerant from the low-temperature compressors and directs flow of the refrigerant to one or both of (i) medium-temperature compressors downstream from the controllable valve and (ii) one or more evaporators based on an operation mode of the evaporators. A pressure-regulating valve is disposed in refrigerant conduit coupling a first flash tank to a second flash tank. After determining to operate a first evaporator in a defrost mode, a controller adjusts the controllable valve to direct a portion of refrigerant to the first evaporator and adjusts the pressure-regulating valve to increase a pressure of the first flash tank relative to that of the second flash tank.

20 Claims, 3 Drawing Sheets

HOT GAS DEFROST USING LOW TEMPERATURE COMPRESSOR DISCHARGE GAS AND AUXILIARY FLASH TANK

TECHNICAL FIELD

This disclosure relates generally to refrigeration systems. More particularly, in certain embodiments, this disclosure relates to hot gas defrost using low temperature compressor discharge gas and auxiliary flash tank.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY OF THE DISCLOSURE

During operation of refrigeration systems, ice may build up on evaporators. These evaporators need to be defrosted to remove ice buildup and prevent loss of performance. Previous evaporator defrost processes are limited in terms of their efficiency and effectiveness. For example, using previous technology, defrost processes may take a relatively long time and consume a relatively large amount of energy. In some cases, previous technology may be incapable of providing adequate defrosting, for instance, in cases where a relatively large number of evaporators need to be defrosted in a multiple-evaporator refrigeration system.

This disclosure provides technical solutions to the problems of previous technology, including those described above. For example, a refrigeration system is described that facilitates improved evaporator defrost using low temperature discharge gas from one or more low-temperature (LT) compressors. While one or a portion of the evaporators of the refrigeration system are operating in a normal refrigeration mode, other evaporator(s) can be operated in a defrost mode using the hot gas produced by the refrigeration process. The pressure of a auxiliary flash tank is regulated to control the pressure of hot gas refrigerant provided during defrost mode operation. A check valve is positioned in refrigerant conduit connecting an outlet of the LT compressor(s) to the auxiliary flash tank and is configured to open if a pressure of refrigerant from the LT compressor(s) exceeds a threshold value. Embodiments of this disclosure may provide improved defrost operations to evaporators of refrigeration systems, such as $CO_2$ refrigeration systems. In certain embodiments, the refrigeration system does not require specialized high pressure evaporator components because hot gas is provided at a moderate pressure from the LT compressor(s). In certain embodiments, system complexity and cost is decreased, for example, because a pressure-regulating valve is not used at the discharge of the LT compressor(s). Certain embodiments may include none, some, or all of the above technical advantages. One or more other technical advantages may be readily apparent to one skilled in the art from the figures, descriptions, and claims included herein.

In an embodiment, a refrigeration system includes a plurality of evaporators including at least one low-temperature evaporator and at least one medium-temperature evaporator. The refrigeration system includes one or more low-temperature compressors configured to compress refrigerant received from the at least one low-temperature evaporator. The refrigeration system includes one or more medium-temperature compressors configured to compress refrigerant received from the at least one medium-temperature evaporator. A controllable valve is positioned downstream from the one or more low-temperature compressors. The controllable valve is configured to receive the compressed refrigerant from the one or more low-temperature compressors and direct flow of the received refrigerant to one or both of (i) the one or more medium-temperature compressors positioned downstream from the controllable valve and (ii) one or more evaporators of the plurality of evaporators based on an operation mode of the plurality of evaporators. A first flash tank (e.g., an auxiliary flash tank) is configured to receive and store cooled refrigerant. A second flash tank (e.g., a primary flash tank) is configured to receive and store a portion of the cooled refrigerant from the first flash tank. A pressure-regulating valve is disposed in refrigerant conduit coupling the first flash tank to the second flash tank. A controller is communicatively coupled to the controllable valve and the pressure-regulating valve. The controller is configured to determine that operation of a first evaporator of the plurality of evaporators in a defrost mode is indicated and, after determining that operation of the first evaporator in the defrost mode is indicated, cause the first evaporator to operate in the defrost mode by adjusting the controllable valve to direct a portion of the received compressed refrigerant to the first evaporator and adjusting the pressure-regulating valve to increase a pressure of the first flash tank relative to a pressure of the second flash tank.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
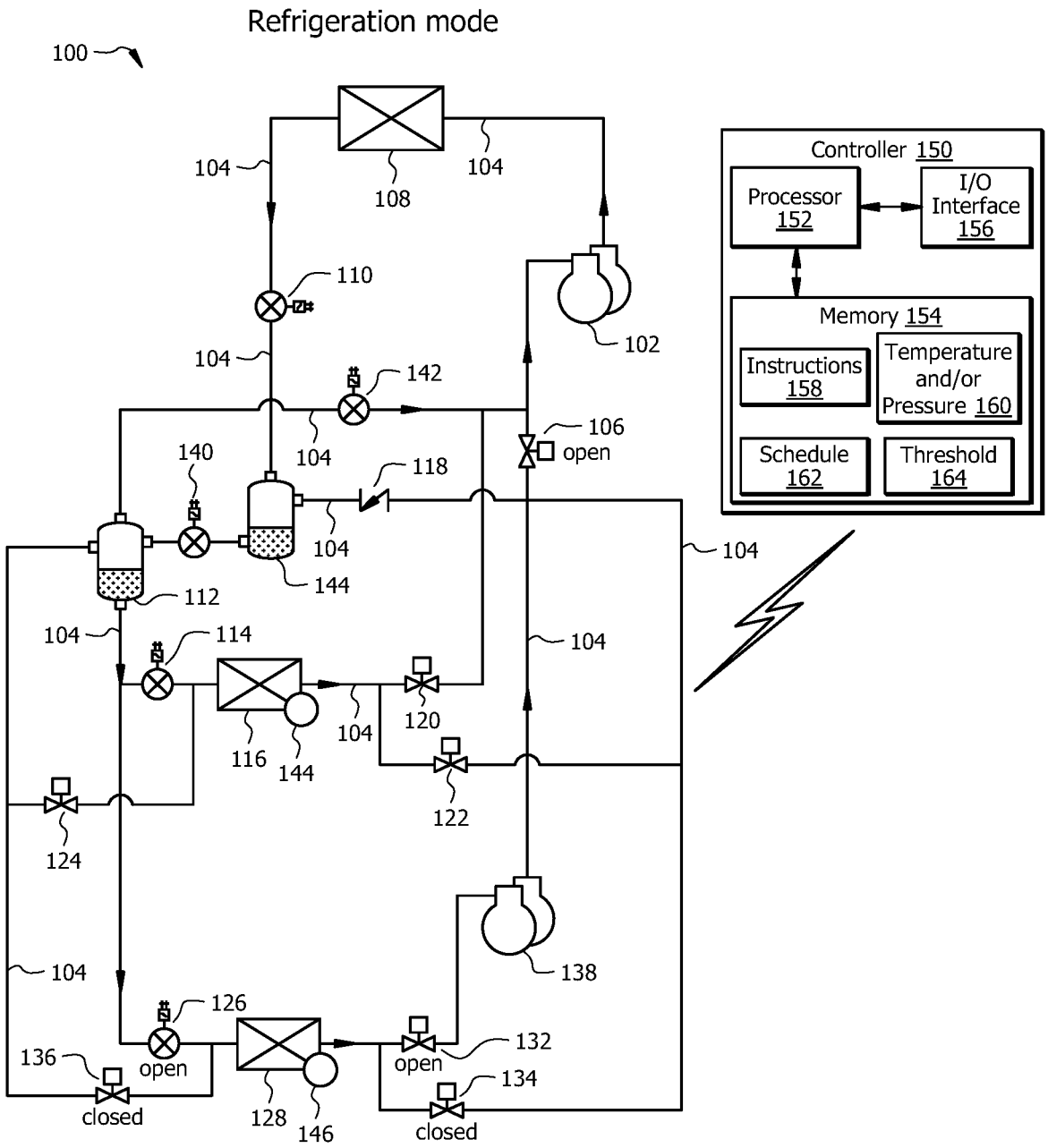
FIG. 1 is a diagram of an example refrigeration system of this disclosure configured to operate evaporators in a refrigeration mode.
Figure 2:
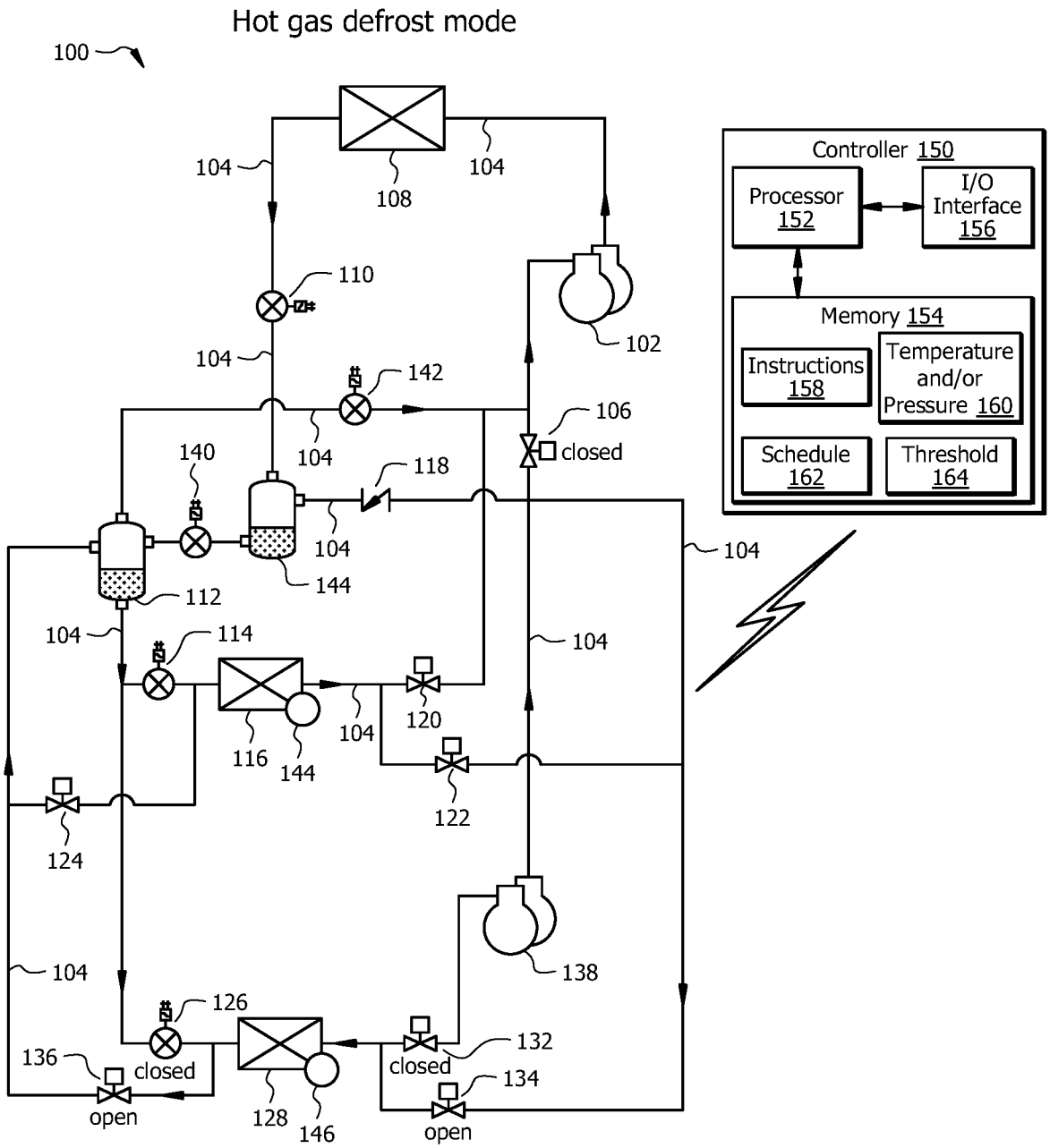
FIG. 2 is a diagram of the example refrigeration system of FIG. 1 configured to operate an evaporator in a defrost mode.
Figure 3:
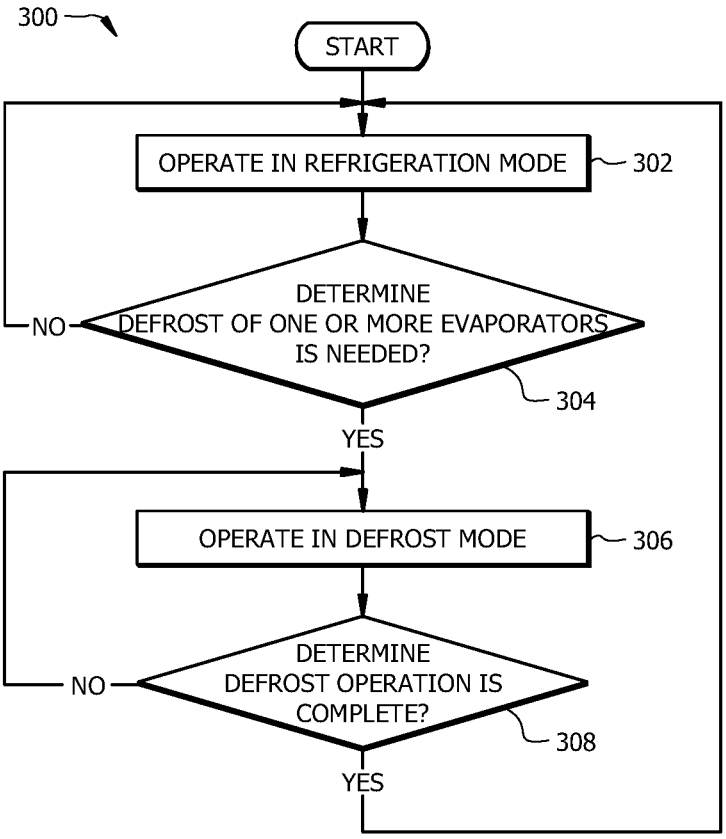
FIG. 3 is a flowchart of an example method of operating the refrigeration system of FIGS. 1 and 2 to provide improved evaporator defrost.

Embodiments of the present disclosure and its advantages are best understood by referring to FIGS. 1-3 of the drawings, like numerals being used for like and corresponding parts of the various drawings.

As described above, prior to this disclosure, defrost operations of refrigeration systems suffered from certain inefficiencies and drawbacks. The refrigeration system of this disclosure provides improvements in defrost performance and energy efficiency. The refrigeration system of this disclosure may be a $CO_2$ refrigeration system. $CO_2$ refrigeration systems may differ from conventional refrigeration systems in that these systems circulate refrigerant that may become a supercritical fluid (i.e., where distinct liquid and gas phases are not present) above the critical point. As an example, the critical point for carbon dioxide ($CO_2$) is 31° C. and 73.8 MPa, and above this point, $CO_2$ becomes a homogenous mixture of vapor and liquid that is called a supercritical fluid. This unique characteristic of transcritical refrigerants is associated with certain operational differences between transcritical and conventional refrigeration systems. For example, transcritical refrigerants are typically associated with discharge temperatures that are higher than their critical temperatures and discharge pressures that are higher than their critical pressures. When a transcritical refrigerant is at or above its critical temperature and/or pressure, the refrigerant may become a "supercritical fluid"—a homogenous mixture of gas and liquid. Supercritical fluid does not undergo phase change process (vapor to liquid) in a gas cooler as occurs in a condenser of a conventional refrigeration system circulating traditional refrigerant. Rather, supercritical fluid cools down to a lower temperature in the gas cooler. Stated differently, the gas cooler in a $CO_2$ transcritical refrigeration system may receive and cool supercritical fluid, and the transcritical refrigerant undergoes a partial state change from gas to liquid as it is discharged from an expansion valve.

Refrigeration System

FIGS. 1 and 2 illustrate an example refrigeration system 100 configured for improved defrost operation. The refrigeration system 100 shown in FIG. 1 is configured to operate evaporators 116, 128 in a refrigeration mode, such that the evaporators 116, 128 provide cooling to a corresponding space, such as a freezer and deep freeze, respectively (not shown for clarity and conciseness). FIG. 2 illustrates the example refrigeration system 100 when configured for operation of evaporator 128 in a defrost mode, such that evaporator 128 is defrosted and evaporator 116 still provides cooling to a space. When at least one of the evaporators 116, 128 is operated in the defrost mode, refrigerant from one or more low-temperature (LT) compressors 138 is provided to the evaporators 116, 128 to facilitate defrosting of the evaporators 116, 128. The refrigerant removes ice buildup from coils of the evaporator(s) 116, 128.

Refrigeration system 100 includes one or more medium-temperature (MT) compressors 102, refrigerant conduit subsystem 104, controllable valve 106, check valve 118, gas cooler 108, primary flash tank 112, auxiliary flash tank 130, one or more MT evaporators 116 and corresponding valves 114, 120, 122, 124, one or more LT evaporators 128 and corresponding valves 126, 132, 134, 136, one or more LT compressors 138, a valve 140, a flash-gas bypass valve 142, and controller 150. In some embodiments, refrigeration system 100 is a transcritical refrigeration system that circulates a transcritical refrigerant such as $CO_2$.

The MT compressor(s) 102 are configured to compress refrigerant discharged from the MT evaporator(s) 116 that are operating in refrigeration mode (as shown in FIGS. 1 and 2) and provide supplemental compression to refrigerant discharged from any of the LT evaporators 128 that are operating in refrigeration mode (as shown in FIG. 1). Refrigeration system 100 may include any suitable number of MT compressors 102. MT compressor(s) 102 may vary by design and/or by capacity. For example, some compressor designs may be more energy efficient than other compressor designs, and some MT compressors 102 may have modular capacity (e.g., a capability to vary capacity). The controller 150 is in communication with the MT compressors 102 and controls their operation.

Refrigerant conduit subsystem 104 facilitates the movement of refrigerant (e.g., $CO_2$) through a refrigeration cycle such that the refrigerant flows in the refrigeration mode as illustrated by the arrows in FIG. 1. The refrigerant conduit subsystem 104 includes conduit, tubing, and the like that facilitates the movement of refrigerant between components of the refrigeration system 100.

Valve 106 is generally a motorized or otherwise electronically controllable valve, such as a motorized ball valve, solenoid valve, or the like. Valve 106 receives compressed refrigerant from the LT compressor(s) 128 and is adjustable to control flow of refrigerant towards one or more of the MT and/or LT evaporators 116, 128 to provide defrost. Valve 106 may be partially or fully closed to direct refrigerant from the LT compressor(s) 138 to defrost one or more evaporators 116, 128. The controller 150 is in communication with valve 106 and controls its operation.

Gas cooler 108 is generally operable to receive refrigerant (e.g., from MT compressor(s) 102) and apply a cooling stage to the received refrigerant. In some embodiments, gas cooler 108 is a heat exchanger comprising cooler tubes configured to circulate the received refrigerant and coils through which ambient air is forced. Inside gas cooler 108, the coils may absorb heat from the refrigerant, thereby cooling the refrigerant.

Auxiliary flash tank 130 is configured to receive mixed-state refrigerant and separate the received refrigerant into flash gas and liquid refrigerant. Auxiliary flash tank 130 may include one or more tanks operable to hold refrigerant at least temporarily. Typically, the flash gas collects near the top of auxiliary flash tank 130, and the liquid refrigerant is collected in the bottom of auxiliary flash tank 130. A valve 110 may be disposed at or near an inlet of the auxiliary flash tank 130 to reduce pressure of refrigerant received by the auxiliary flash tank 130. The auxiliary flash tank 130 is coupled to the primary flash tank 112 via refrigerant conduit of the refrigerant conduit subsystem 104. As with the auxiliary flash tank 130, flash gas collects near the top of primary flash tank 112, and liquid refrigerant is collected in the bottom of primary flash tank 112. A pressure-regulating valve 140 is disposed in the conduit coupling the auxiliary flash tank 130 to the primary flash tank 112.

When both evaporators 116 and 128 are operated in refrigeration mode (see FIG. 1), the auxiliary flash tank 130 and primary flash tank 112 are held at about the same pressure with valve 140 fully open. Under these conditions, the two flash tanks 112 and 130 function similarly to a single larger tank. The liquid refrigerant from primary flash tank 112 flows to and provides cooling to the MT evaporator 116 and LT evaporator 128.

When evaporator 128 is operated in defrost mode (see FIG. 2), valve 140 is adjusted (e.g., at least partially closed) to increase the pressure in the auxiliary flash tank 130 relative to the primary flash tank 112 (e.g., by 50 psi). Hot gas refrigerant provided to defrost evaporator 128 is provided to primary flash tank 112. Flash gas from the primary flash tank 112 is provided to the MT compressor(s) 102.

When operated in refrigeration mode (see FIG. 1), the MT evaporator 116 receives cooled liquid refrigerant from the primary flash tank 112 and uses the cooled refrigerant to provide cooling. As an example, the evaporator 116 may be part of a refrigerated case and/or cooler for storing items that must be kept at particular temperatures. The refrigeration system 100 may include any appropriate number of MT evaporators 116 with the same or a similar configuration to that shown for the example MT evaporator 116 shown in FIGS. 1 and 2.

Each of the one or more MT evaporators 116 has corresponding valves 114, 120, 122, 124 to facilitate operation of the MT evaporator 116 in a refrigeration mode and a defrost mode. Valve 114 may be an expansion valve. Expansion valve 114 may be configured to receive liquid refrigerant from primary flash tank 112 and reduce the pressure of the received refrigerant. In some embodiments, this reduction in pressure causes some of the refrigerant to vaporize. Valves 120, 122, 124 may be any appropriate motorized or electronically controllable valves, such as motorized ball valves, solenoid valves, and/or the like. The controller 150 is in communication with valves 114, 120, 122, 124 and controls their operation.

When the MT evaporator 116 is operated in the refrigeration mode illustrated in FIGS. 1 and 2, the first valve 114 upstream of the evaporator 116 is open and the second valve 120 downstream of the evaporator 116 is open. The third valve 124 and fourth valve 122 are both closed. In this configuration, the liquid refrigerant from primary flash tank 112 flows through expansion valve 114, where the pressure of the refrigerant is decreased, before it reaches the evaporator 116. Expansion valve 114 may be configured to achieve a refrigerant temperature into the evaporator 116 at a predefined temperature for a given application (e.g., about −6° C.). Refrigerant from the MT evaporator 116 that is operating in refrigeration mode is provided to the one or more MT compressors 102.

When the MT evaporator 116 is operated in the defrost mode (not shown for conciseness), valve 106 is adjusted such that at least a portion of compressed refrigerant from the LT compressor(s) 138 is directed towards the MT evaporator 116 (e.g., by at least partially closing valve 106). Valve 140 is also adjusted to increase the pressure of the auxiliary flash tank 130 relative to the pressure of the primary flash tank 112. The first valve 114 upstream of the evaporator 116 is closed, and the second valve 120 downstream of the evaporator 116 is closed. Third valve 124 and fourth valve 122 are opened to allow flow of compressed refrigerant from the valve 106 toward the MT evaporator 116. In this configuration, heated refrigerant from LT compressor(s) 138 flows through the evaporator 116 and defrosts the evaporator 116. Refrigerant exiting the evaporator 116 flows through the opened valve 124 and to the primary flash tank 112, which is at a lower pressure than the auxiliary flash tank 130.

Once defrost mode operation is complete, the controller 150 may end defrost mode operation and return to refrigeration mode operation by opening valve 106 and 140, closing valves 122 and 124, and opening valves 114 and 120. In some embodiments, the controller 150 may cause defrost mode to end after a predefined period of time included in the instructions 158 and/or schedule 162. In some embodiments, the controller 150 may cause defrost mode operation to end after predefined conditions indicated in the instructions 158 are reached (e.g., after a temperature and/or pressure 160 measured by sensor 144 reaches a threshold 164).

The LT evaporator 128 is generally similar to the MT evaporator 116 but is configured to operate at lower temperatures (e.g., for deep freezing applications near about −30° C. or the like). When operated in refrigeration mode (see FIG. 1), the LT evaporator 128 receives cooled liquid refrigerant from the primary flash tank 112 and uses the cooled refrigerant to provide cooling. As an example, the evaporator 128 may be part of a deep freezer for relatively long-term storage of perishable items that must be kept at particular temperatures. For clarity and conciseness, the components of a single LT evaporator 128 are illustrated. The refrigeration system 100 may include any appropriate number of LT evaporators 128 with corresponding valves 126, 132, 134, 136.

The LT evaporator 128 includes valves 126, 132, 134, 136 to facilitate operation of the LT evaporator 128 in a refrigeration mode (see FIG. 1) and a defrost mode (see FIG. 2). Valve 126 may be an expansion valve that is the same as or similar to valve 114, described above. Expansion valve 126 may be configured to receive liquid refrigerant from primary flash tank 112 and reduce the pressure of the received refrigerant. In some embodiments, this reduction in pressure causes some of the refrigerant to vaporize. Valves 132, 134, 136 may be any appropriate motorized or electronically controllable valves, such as motorized ball valves, solenoid valves, and/or the like (e.g., the same as or similar to valve 120, 122, 124, described above). The controller 150 is in communication with valves 126, 132, 134, 136 and controls their operation.

When the LT evaporator 128 is operated in the refrigeration mode illustrated in FIG. 1, the first valve 126 upstream of the evaporator 128 is open and the second valve 132 downstream of the evaporator 128 is open. The third valve 136 and fourth valve 134 are both closed. In this configuration, the liquid refrigerant from primary flash tank 112 flows through expansion valve 126, where the pressure of the refrigerant is decreased, before it reaches the evaporator 128. Expansion valve 126 may be configured to achieve a refrigerant temperature into the evaporator 128 at a predefined temperature for a given application (e.g., about −30° C.). Refrigerant from the LT evaporator 128 that is operating in refrigeration mode is provided to the one or more LT compressors 138.

When the LT evaporator 128 is operated in the defrost mode of FIG. 2, the valve 106 is adjusted such that at least a portion of compressed refrigerant from the LT compressor(s) 138 is directed towards the LT evaporator 128 (e.g., by at least partially closing valve 106). Valve 140 is also adjusted to increase the pressure of the auxiliary flash tank 130 relative to the pressure of the primary flash tank 112. The first valve 126 upstream of the evaporator 128 is closed, and the second valve 132 downstream of the evaporator 128 is closed. Third valve 136 and fourth valve 134 are opened to allow flow of compressed refrigerant from the valve 106 toward the LT evaporator 128. In this configuration, heated refrigerant from LT compressor(s) 138 flows through the evaporator 128 and defrosts the evaporator 128. Refrigerant exiting the evaporator 128 flows through the opened valve 136 and to primary flash tank 112.

Once defrost mode operation is complete, the controller 150 may end defrost mode operation and return to refrigeration mode operation by opening valve 106 and 140, closing valves 134 and 136 and opening valves 126 and 132, as shown in the example of FIG. 1. In some embodiments, the controller 150 may cause defrost mode to end after a predefined period of time included in the instructions 158 and/or schedule 162. In some embodiments, the controller 150 may cause defrost mode operation to end after predefined conditions indicated in the instructions 158 are reached (e.g., after a temperature and/or pressure 160 measured by sensor 146 reaches a threshold 164).

The temperature and/or pressure sensors 144, 146 may be disposed on, in, or near the corresponding evaporators 116, 128 or refrigerant conduit connected to the evaporators 116, 128. Information from sensors 144, 146 may assist in determining when operation in defrost mode is appropriate or should be ended. For example, if the temperature and/or pressure 160 measured by sensors 144, 146 indicates potential freezing of the MT evaporator 116 and/or LT evaporator 128, defrost mode operation may be indicated. In some cases, defrost mode operation is determined to be indicated based on a schedule 162 (e.g., defrost mode operation may be performed at certain predefined time intervals or at certain times).

Valves 114, 120, 122, and 124 for the MT evaporator 116 and valves 126, 132, 134, and 136 for the LT evaporator 128 may be in communication with controller 150, and the controller 150 may provide instructions for adjusting these valves 114, 120, 122, 124, 126, 132, 134, 136 to open or closed positions to achieve the configurations described above for refrigeration mode operation and defrost mode operation. For example, instructions 158 implemented by the processor 152 of the controller 150 may determine that operation of the MT evaporator 116 and/or the LT evaporator 128 in a defrost mode is indicated. For example, instructions 158 stored by the controller 150 may indicate that defrost mode operation is needed on a certain schedule 162 or at a certain time. As another example, a temperature and/or pressure 160 of the evaporators 116, 128 may indicate that defrost mode operation is needed (e.g., because the temperature and/or pressure 160 indicates that expected cooling performance or efficiency is not being obtained).

A check valve 118 is positioned in refrigerant conduit of the conduit subsystem 104 coupling an outlet of the LT compressor(s) 138 to an inlet of the auxiliary flash tank 130. The check valve 118 is configured to allow flow of refrigerant from the LT compressor(s) 138 to the auxiliary flash tank 130 when a pressure difference across the check valve exceeds a threshold value (e.g., of about 1 bar to 3 bar). In other words, the check valve 118 is a one-way valve and prevents flow from the auxiliary flash tank 130 to the conduit subsystem 104 connecting to the LT compressor(s) 138 and only allows flow to the auxiliary flash tank 130 if a threshold pressure is reached. If the pressure difference across the check valve 118 is below the threshold value, flow is prevented to the auxiliary flash tank 130.

Flash gas bypass valve 142 may be located in refrigerant conduit of the conduit subsystem 104 connecting the primary flash tank 112 to the MT compressor(s) 102 and configured to open and close to permit or restrict the flow of flash gas discharged from primary flash tank 112. In some embodiments, controller 150 controls the opening and closing of flash gas bypass valve 142. As depicted in FIGS. 1 and 2, closing flash gas bypass valve 142 may restrict flash gas from flowing to MT compressor(s) 102, and opening flash gas bypass valve 142 may permit flow of flash gas to MT compressor(s) 102.

As described above, controller 150 is in communication with at least valve 106 and 140; valves 114, 120, 122, and 124 of the MT evaporator 116; valves 126, 132, 134, and 136 of the LT evaporator 128; and compressors 102, 138. The controller 150 adjusts operation of components of the refrigeration system 100 to operate the evaporators 116, 128 in refrigeration mode or defrost mode, as described herein. The controller 150 includes a processor 152, memory 154, and input/output (I/O) interface 156. The processor 152 includes one or more processors operably coupled to the memory 154. The processor 152 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 154 and controls the operation of refrigeration system 100.

The processor 152 may be a programmable logic device, a microcontroller, a microprocessor, or any suitable combination of the preceding. The processor 152 is communicatively coupled to and in signal communication with the memory 154. The one or more processors are configured to process data and may be implemented in hardware or software. For example, the processor 152 may be 8-bit, 16-bit, 32-bit, 64-bit or of any other suitable architecture. The processor 152 may include an arithmetic logic unit (ALU) for performing arithmetic and logic operations, processor registers that supply operands to the ALU and store the results of ALU operations, and a control unit that fetches instructions from memory 154 and executes them by directing the coordinated operations of the ALU, registers, and other components. The processor 152 may include other hardware and software that operates to process information, control the refrigeration system 100, and perform any of the functions described herein (e.g., with respect to FIGS. 1-3). The processor 152 is not limited to a single processing device and may encompass multiple processing devices. Similarly, the controller 150 is not limited to a single controller but may encompass multiple controllers.

The memory 154 includes one or more disks, tape drives, or solid-state drives, and may be used as an over-flow data storage device, to store programs when such programs are selected for execution, and to store instructions 158 and data that are read during program execution. The memory 154 may be volatile or non-volatile and may include ROM, RAM, ternary content-addressable memory (TCAM), dynamic random-access memory (DRAM), and static random-access memory (SRAM). The memory 154 is operable (or configured) to store information used by the controller 150 and/or any other logic and/or instructions for performing the function described in this disclosure.

The I/O interface 156 is configured to communicate data and signals with other devices. For example, the I/O interface 156 may be configured to communicate electrical signals with components of the refrigeration system 100 including valves 106, 114, 120, 122, 124, 126, 132, 134, 136, 140, 142; sensors 144, 146; and compressors 102, 138. The I/O interface 156 may be configured to communicate with other devices and systems. The I/O interface 156 may provide and/or receive, for example, compressor speed signals, compressor on/off signals, valve open/close signals, temperature signals, pressure signals, temperature setpoints, environmental conditions, and an operating mode status for the refrigeration system 100 and send electrical signals to the components of the refrigeration system 100. The I/O interface 156 may include ports or terminals for establishing signal communications between the controller 150 and other devices. The I/O interface 156 may be configured to enable wired and/or wireless communications.

Although this disclosure describes and depicts refrigeration system 100 including certain components, this disclosure recognizes that refrigeration system 100 may include any suitable components. As an example, refrigeration system 100 may include one or more additional sensors configured to detect temperature and/or pressure information.

In an example operation of the refrigeration system 100, the refrigeration system 100 is initially operating with both evaporators 116, 128 in the refrigeration mode, as illustrated in FIG. 1. In this mode, valves 106 and 140 are open, first valve 126 and second valve 132 of LT evaporator 128 are open, and third valve 136 and fourth valve 134 of LT evaporator 128 are closed.

At some point during operation of the refrigeration system 100, the controller 150 determines that defrost mode operation is needed for the LT evaporator 128. For example, the LT evaporator 128 may be scheduled for defrost at the time that has just been reached. After determining that the defrost mode operation is indicated, the controller 150 causes the LT evaporator 128 to be configured according to FIG. 2. In other words, the controller 150 causes the valve 106 to allow a portion of refrigerant from the LT compressor(s) 138 to flow towards the LT evaporator 128 (e.g., by partially closing valve 106). Valve 140 is adjusted (e.g., partially closed) to increase the pressure of the auxiliary flash tank 130 relative to the pressure of the primary flash tank 112. First valve 126 and second valve 132 are closed, and third valve 136 and fourth valve 134 are opened.

Once defrost of the LT evaporator 128 is complete (e.g., because defrost mode operation has been performed for a predefined period of time and/or a threshold pressure and/or temperature 160 of the LT evaporator 128 has been reached), the controller 150 causes the LT evaporator 128 to operate in the refrigeration mode, as illustrated in FIG. 1 and described above.

Example Method of Operation

FIG. 3 illustrates an example method 300 of operating the refrigeration system 100 described above with respect to FIGS. 1 and 2. The method 300 may be implemented using the processor 152, memory 154, and I/O interface 156 of the controller 150 of FIGS. 1 and 2. The method 300 may begin at operation 302 where the controller 150 initially operates the evaporator 116, 128 in the refrigeration mode. At operation 304, the controller 150 determines whether defrost mode is indicated for any of the evaporators 116, 128. For example, the controller 150 may determine whether the instructions 158 and/or schedule 162 indicate that a defrost cycle is needed for one of the evaporators 116, 128. As another example, the controller 150 may determine whether a temperature and/or pressure 160 measured at an evaporator 116, 128 indicates decreased performance (e.g., if a target or threshold value 164 of temperature and/or pressure 160 is not being reached). This behavior may indicate that a defrost mode operation is indicated. If defrost mode is not indicated, the controller 150 returns to operation 302 and continues to operate the evaporators 116, 128 in the refrigeration mode. If defrost mode operation is indicated, the controller 150 proceeds to operation 306.

At operation 306, the controller 150 causes the evaporator 116, 128 determined at operation 304 to be operated in the defrost mode. For instance, if defrost of the LT evaporator 128 is needed, the controller 150 causes the valve 106 to allow a portion of refrigerant from the LT compressor(s) 138 to flow towards the LT evaporator 128. The controller 150 adjusts valve 140 to increase the pressure of the auxiliary flash tank 130 relative to the pressure of the primary flash tank 112. First valve 126 and second valve 132 are closed, and third valve 136 and fourth valve 134 are opened. This achieves the defrost mode configuration of evaporator 128 illustrated in FIG. 2.

At operation 308, the controller 150 determines whether defrost mode operation of the evaporator 128 is complete. For example, the controller 150 may determine whether defrost mode operation has been performed for a predefined period of time indicated by schedule 162 and/or if a threshold value 164 is reached for a pressure and/or temperature 160 of the LT evaporator 128. If defrost mode operation is not complete, the controller continues to operate in the defrost mode at operation 306. Once defrost mode operation is complete, the controller 150 returns to operation 302 and operates the evaporator 128 in the refrigeration mode.

Modifications, additions, or omissions may be made to method 300 depicted in FIG. 3. Method 300 may include more, fewer, or other operations. For example, operations may be performed in parallel or in any suitable order. While at times discussed as controller 150, refrigeration system 100, or components thereof performing the operations, any suitable refrigeration system or components of the refrigeration system may perform one or more operations of the method 300.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, comprising:

a plurality of evaporators comprising at least one low-temperature evaporator and at least one medium-temperature evaporator;

one or more low-temperature compressors configured to compress refrigerant received from the at least one low-temperature evaporator;

one or more medium-temperature compressors configured to compress refrigerant received from the at least one medium-temperature evaporator;

a first controllable valve positioned downstream from the one or more low-temperature compressors, the first controllable valve configured to receive the compressed refrigerant from the one or more low-temperature compressors and direct flow of the received refrigerant to one or both of (i) the one or more medium-temperature compressors positioned downstream from the controllable valve and (ii) one or more evaporators of the plurality of evaporators based on an operation mode of the plurality of evaporators;

a first flash tank configured to receive and store cooled refrigerant;

a second flash tank configured to receive and store a portion of the cooled refrigerant from the first flash tank;

a pressure-regulating valve disposed in a first refrigerant conduit coupling the first flash tank to the second flash tank;

a second controllable valve positioned in a second refrigerant conduit coupling a first evaporator of the plurality of evaporators to an outlet of the first flash tank;

and a controller communicatively coupled to the controllable valve and the pressure-regulating valve, wherein the controller is configured to:

determine that operation of the first evaporator in a defrost mode is indicated; and after determining that operation of the first evaporator in the defrost mode is indicated, cause the first evaporator to operate in the defrost mode by opening the second controllable valve and adjusting the first controllable valve to direct a portion of the refrigerant from the first flash tank to the first evaporator and adjusting the pressure-regulating valve to increase a pressure of the first flash tank relative to a pressure of the second flash tank.

2. The refrigeration system of claim 1, wherein the controller is further configured to cause the first evaporator to operate in the defrost mode by at least partially closing the first controllable valve.

3. The refrigeration system of claim 1, wherein the controller is further configured to cause the first evaporator to operate in the defrost mode by partially closing the pressure-regulating valve.

4. The refrigeration system of claim 1, further comprising:

a first valve located upstream from the first evaporator in a third refrigerant conduit coupling a liquid outlet of the second flash tank to the first evaporator, wherein, when the first evaporator is operating in a refrigeration mode, the first valve is open; and a second valve located downstream from the first evaporator in a fourth refrigerant conduit allowing flow of refrigerant towards the one or more medium-temperature compressors, wherein, when the first evaporator is operating in the refrigeration mode, the second valve is open;

wherein the controller is further configured to cause the first evaporator to operate in the defrost mode by causing the first valve to close and causing the second valve to close.

5. The refrigeration system of claim 4, further comprising:

a third valve located upstream from the first evaporator in a fifth refrigerant conduit coupling an inlet of the second flash tank to the first evaporator, wherein, when the first evaporator is operating in a refrigeration mode, the second controllable valve and the third valve are closed;

wherein the controller is further configured to cause the first evaporator to operate in the defrost mode by causing the third valve to open.

6. The refrigeration system of claim 1, further comprising a check valve positioned in a sixth refrigerant conduit coupling an outlet of the one or more low-temperature compressors to the outlet of the first flash tank, wherein the check valve is configured to allow flow of refrigerant from the one or more low-temperature compressors to the flash tank when a pressure difference across the check valve exceeds a threshold value.

7. The refrigeration system of claim 1, wherein the controller is further configured to:

determine that defrost mode operation of the first evaporator is complete; and after determining that defrost mode operation of the first evaporator is complete, cause the first evaporator to operate in a refrigeration mode.

8. The refrigeration system of claim 1, wherein, while the first evaporator is caused to operate in the defrost mode, a second evaporator of the plurality of evaporators is caused to operate in a refrigeration mode.

9. A method of operating a refrigeration system, the method comprising:

operating a first evaporator of a plurality of evaporators in a refrigeration mode;

determining that operation of the first evaporator in a defrost mode is indicated; and after determining that operation of the first evaporator in the defrost mode is indicated, causing the first evaporator to operate in the defrost mode by:

adjusting a first controllable valve positioned in a first refrigerant conduit coupling one or more low-temperature compressors of the refrigeration system to one or more medium-temperature compressors of the refrigeration system;

adjusting a second controllable valve positioned in a second refrigerant conduit coupling an outlet of a first flash tank to the first evaporator;

directing at least a portion of refrigerant from the first flash tank to the first evaporator; and adjusting a pressure-regulating valve disposed in a third refrigerant conduit coupling the first flash tank to a second flash tank to increase a pressure of the first flash tank relative to a pressure of the second flash tank, wherein the first flash tank is configured to receive and store refrigerant cooled by a gas cooler and the second flash tank is configured to receive and store a portion of the cooled refrigerant from the first flash tank.

10. The method of claim 9, further comprising causing the first evaporator to operate in the defrost mode by at least partially closing the first controllable valve.

11. The method of claim 9, further comprising causing the first evaporator to operate in the defrost mode by partially closing the pressure-regulating valve.

12. The method of claim 11, further comprising causing the first evaporator to operate in the defrost mode by:

closing a first valve located upstream from the first evaporator in a fourth refrigerant conduit coupling a liquid outlet of the second flash tank to the first evaporator; and closing a second valve located downstream from the first evaporator in a fifth refrigerant conduit coupling the first evaporator to the one or more medium-temperature compressors.

13. The method of claim 12, further comprising:

opening a third valve located upstream from the first evaporator in a sixth refrigerant conduit coupling an inlet of the second flash tank to the first evaporator.

14. The method of claim 11, further comprising: allowing flow of refrigerant from the one or more low-temperature compressors to the first flash tank when a pressure difference across a check valve position in a seventh refrigerant conduit coupling an outlet of the one or more low-temperature compressors to an inlet of the first flash tank, exceeds a threshold value.

15. The method of claim 9, further comprising:

determining that defrost mode operation of the first evaporator is complete; and after determining that defrost mode operation of the first evaporator is complete, causing the first evaporator to operate in the refrigeration mode.

16. The method of claim 9, wherein, while the first evaporator is caused to operate in the defrost mode, a second evaporator of the plurality of evaporators is caused to operate in a refrigeration mode.

17. A controller of a refrigeration system, the controller comprising:

an input/output interface communicatively coupled to:

a first controllable valve positioned downstream from one or more low-temperature compressors, the first controllable valve configured to receive compressed refrigerant from the one or more low-temperature compressors and direct flow of the received refrigerant to one or both of (i) one or more medium-temperature compressors positioned downstream from the controllable valve and (ii) one or more evaporators of a plurality of evaporators of the refrigeration system based on an operation mode of the plurality of evaporators;

a pressure-regulating valve disposed in a first refrigerant conduit coupling a first flash tank to a second flash tank, wherein the first flash tank is configured to receive and store refrigerant cooled by a gas cooler and the second flash tank is configured to receive and store a portion of the cooled refrigerant from the first flash tank; and a second controllable valve positioned in a second refrigerant conduit coupling an outlet of a first evaporator of the plurality of evaporators to an outlet of the first flash tank; and a processor configured to:

determine that operation of the first evaporator in a defrost mode is indicated; and after determining that operation of the first evaporator in the defrost mode is indicated, cause the first evaporator to operate in the defrost mode by opening the second controllable valve and adjusting the first controllable valve to direct a portion of the refrigerant from the first flash tank to the first evaporator and adjusting the pressure-regulating valve to increase a pressure of the first flash tank relative to a pressure of the second flash tank.

18. The controller of claim 17, wherein the processor is further configured to cause the first evaporator to operate in the defrost mode by closing the first controllable valve and partially closing the pressure-regulating valve.

19. The controller of claim 17, wherein:

the input/output interface communicatively coupled to:

a first valve located upstream from the first evaporator in a third refrigerant conduit coupling a liquid outlet of the second flash tank to the first evaporator, wherein, when the first evaporator is operating in a refrigeration mode, the first valve is open; and a second valve located downstream from the first evaporator in a fourth refrigerant conduit allowing flow of refrigerant towards the one or more medium-temperature compressors, wherein, when the first evaporator is operating in the refrigeration mode, the second valve is open; and the processor is further configured to cause the first evaporator to operate in the defrost mode by causing the first valve to close and causing the second valve to close.

20. The controller of claim 19, wherein:

the input/output interface is further communicatively coupled to:

a third valve located upstream from the first evaporator in a fifth refrigerant conduit coupling an inlet of the second flash tank to the first evaporator, wherein, when the first evaporator is operating in a refrigeration mode, the second controllable valve and the third valve are closed; and the processor is further configured to cause the first evaporator to operate in the defrost mode by causing the third valve to open.

* * * * *